United States Patent [19]

Schneck

[11] 4,028,912

[45] June 14, 1977

[54] FABRIC TAKE-UP MECHANISM

[75] Inventor: Richard Schneck, Deizisan, Germany

[73] Assignee: Sulzer Morat GmbH, Bonlanden, Germany

[22] Filed: Dec. 17, 1975

[21] Appl. No.: 641,652

[30] Foreign Application Priority Data

Dec. 27, 1974 Germany ..... 2461638

[52] U.S. Cl. ..... 66/149 R; 66/152; 139/308; 242/75

[51] Int. Cl.[2] ..... D04B 15/88; D04B 27/34

[58] Field of Search ..... 66/149–153; 139/304, 307, 308; 242/75, 75.1

[56] References Cited

UNITED STATES PATENTS

| | | | |
|---|---|---|---|
| 1,952,904 | 3/1934 | Bostwick | 242/75 |
| 2,064,710 | 12/1936 | Wirth | 66/149 R |
| 2,870,618 | 1/1959 | Zeruneith | 66/152 |
| 3,645,300 | 2/1972 | Geven et al. | 139/308 |
| 3,760,609 | 9/1973 | Poocza et al. | 66/149 R |

FOREIGN PATENTS OR APPLICATIONS

| | | | |
|---|---|---|---|
| 1,171,554 | 6/1904 | Germany | 66/149 R |
| 63,121 | 1/1941 | Norway | 66/149 R |
| 3,868 | 1875 | United Kingdom | 139/308 |

*Primary Examiner*—James Kee Chi

[57] ABSTRACT

A drawing-off mechanism having at least two driven rollers for drawing off knitted fabric in which the rollers are positively driven at the same peripheral speed while being resiliently pressed against each other to permit drawing off fabrics of varying thicknesses without slippage.

10 Claims, 3 Drawing Figures

FABRIC TAKE-UP MECHANISM

The invention concerns a fabric drawing off mechanism, particularly suitable for circular knitting machines and circular knitting frames, and having at least two draw-off rollers adapted to be pressed resiliently against one another by a tightening device, and between which rollers the tubular fabric passes.

In known fabric drawing-off mechanisms of this kind (German Patent Specification No. 1,585,042, U.S. Patent Specifications Nos. 2,751,768 and 2,864,248, two or three draw-off rollers are provided, at least one draw-off roller being mounted stationary and being positively driven. The other draw-off rollers age mounted with their axles in slide blocks and are slidable at right-angles to the axial direction. They are driven by toothed-wheel gears off the positively driven draw-off roller and are pressed together by means of spring-loaded levers so that the roller gaps can be automatically adapted to the thickness provided in the individual case of the tubular fabric made on the knitting machine.

If the thickness of the material made is to be able to fluctuate considerably, special toothed wheel gears have to be made for transmitting the torque from the driven draw-off roller to the other draw-off rollers, since the fabric draw-off must be equally good for all possible material thicknesses. Such special constructions involve comparatively hight costs, and in the case of extreme fabric thicknesses, no longer ensure reliable engagement of the toothed wheels The invention is based on the problem of eliminating these disadvantages by simple constructional means.

According to this invention there is provided a fabric drawing-off mechanism for knitting machines, having at least two draw-off rollers which are adapted to be pressed together resiliently be a tightening device and between which the tubular fabric passes, wherein the tightening device comprises a resiliently-loaded endless tension member which passes around guiding elements fixed respectively to the draw-off roller axles.

The endless tension member may for example consist of a belt or chain. Depending on the construction of the tension member, guiding, tightening and driving elements may be provided consisting a pulleys, chain wheels or the like.

Figure 1:
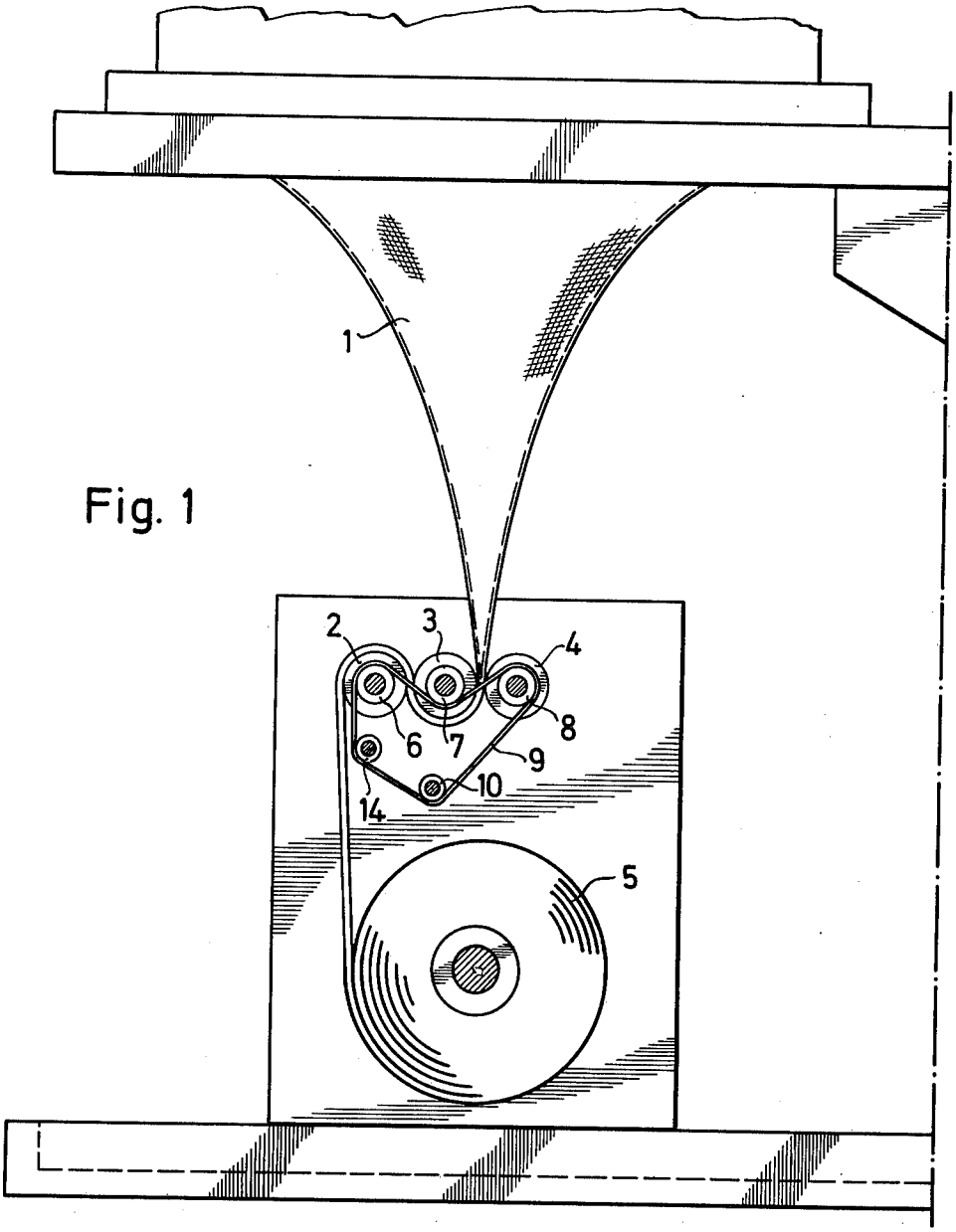
Figure 2A:
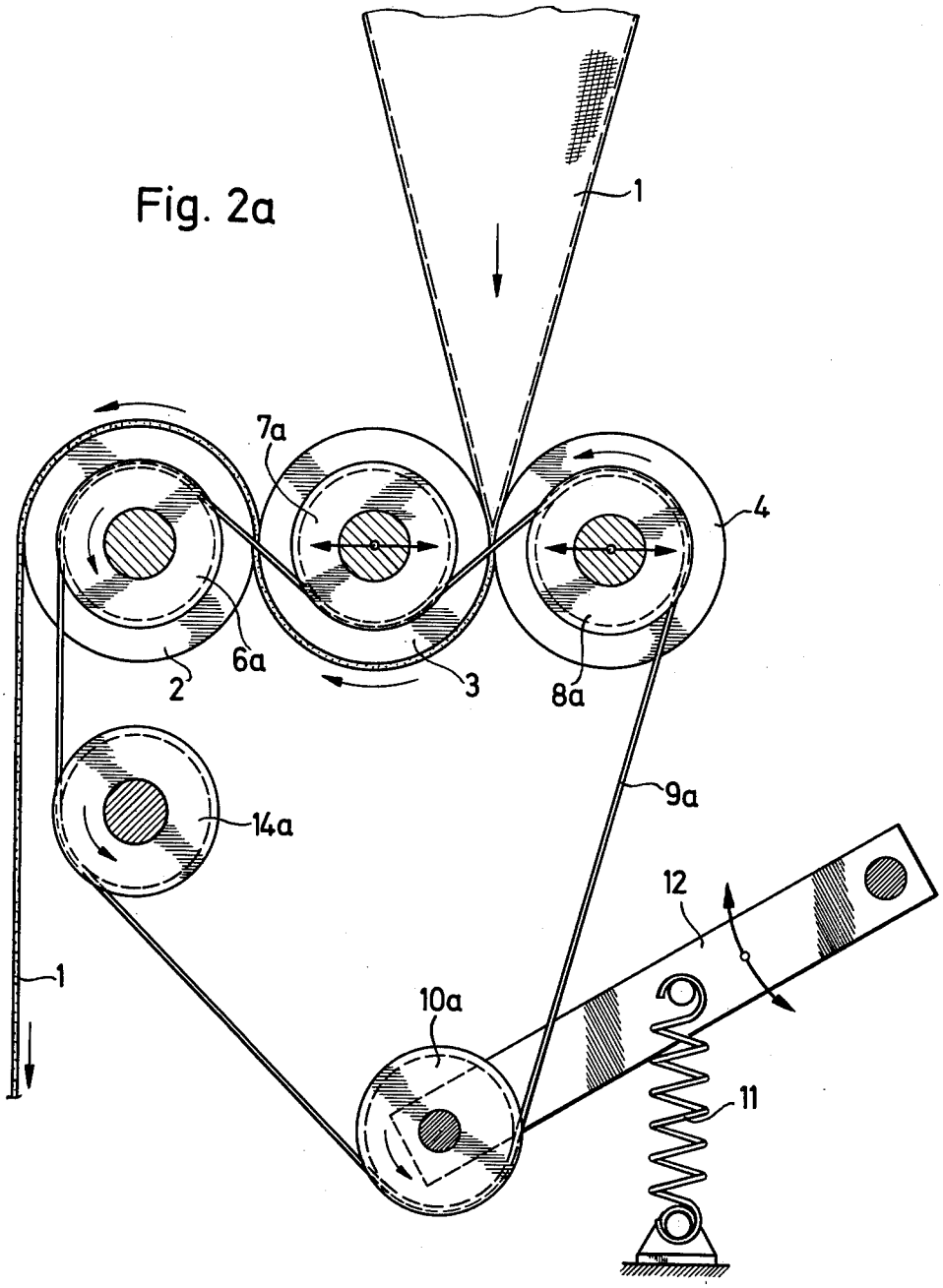
Figure 2B:
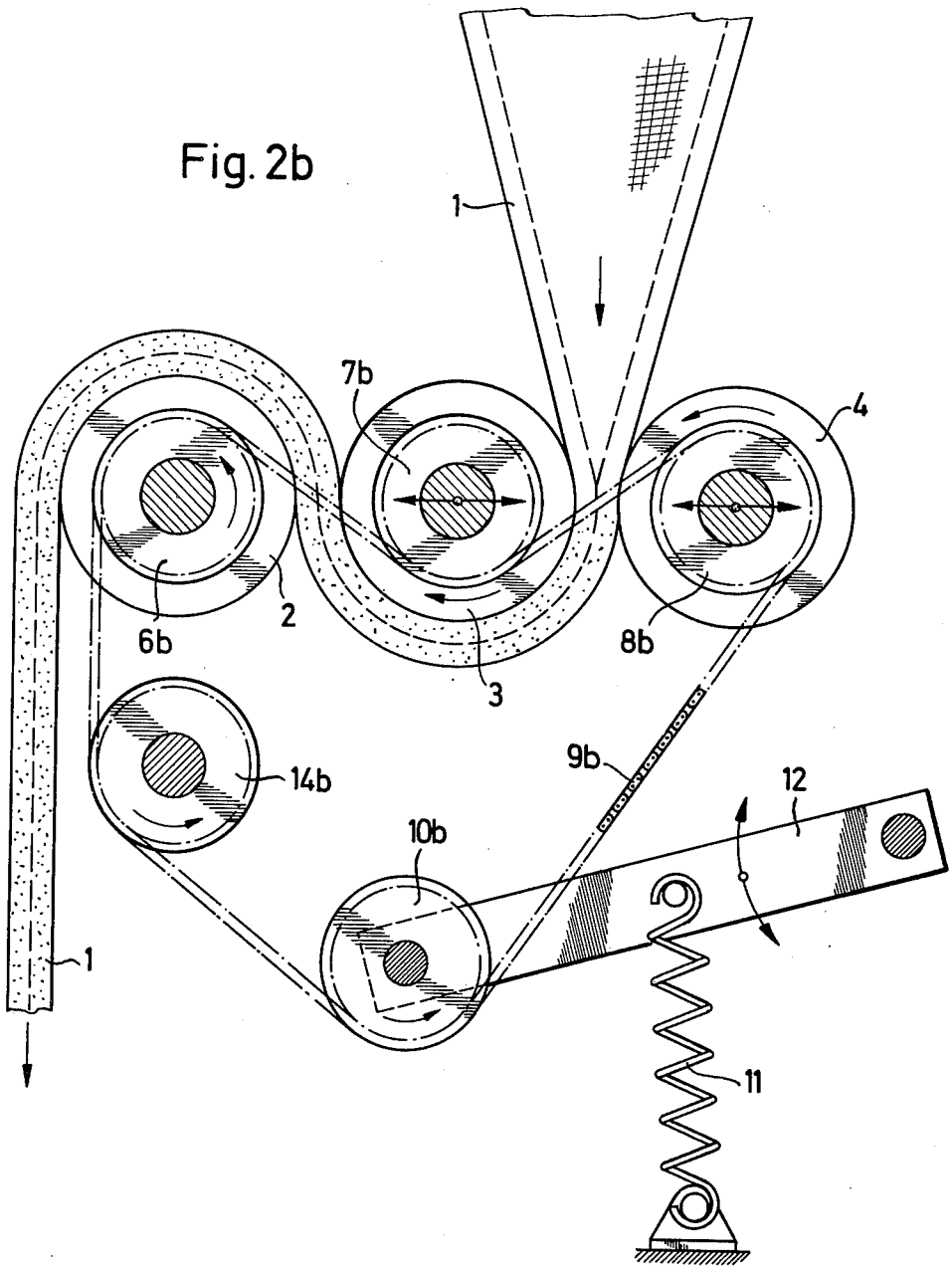

The invention will now be described in more detail by way of example with reference to the accompanying drawings, in which:

FIG. 1 shows diagrammatically a circular knitting machine with a draw-off and wind-on device for the tubular fabric, and FIGS. 2*a* and 2*b* show diagrammatically and on a larger scale a fabric take-up mechanism consisting of three draw-off rollers, used with two different thicknesses of fabric respectively.

FIG. 1 indicates diagrammatically the frame of a circular knitting machine. The needle cylinder, arranged above a base plate, with the loop-forming members pertaining thereto, is not shown since this is not necessary for understanding the fabric drawing-off mechanism. Below the base plate, within the machine frame, is shown the drawing off and wind-on device for the tubular fabric 1 made in the knitting process and emerging below the base plate, the said tubular fabric being drawn-off by three draw-off rollers 2, 3 and 4 and then wound on a winding roller 5.

Fixed on the ends of the axles of the draw off rollers 2, 3 and 4 are guiding elements in the form of pulleys 6*a*, 7*a* and 8*a* or chain wheels 6*b*, 7*b* and 8*b*, around which passes an endless tightening band in the form of a belt 9*a* or chain 9*b*. In addition, the tightening band passes over a tightening element in the form of a pulley 10*a* or chain wheel, 10*b* mounted on a pivotally mounted lever 12 prestressed by a spring 11. A positively driven driving wheel 14*a*, 14*b* serves to drive the tightening band 9*a*, 9 *b*.

The ends of the axles of the draw-off roller 2 are preferably rigidly mounted, the ends of the draw-off rollers 3 and 4, on the contrary, are mounted in bearing elements movable to-and-fro in guides in a direction at right-angles to the draw-off roller axles, as shown by the double-headed arrows in FIGS. 2*a* and 2*b*.

FIGS. 2*a* and 2*b* show the positions which the draw-off rollers can assume. In the position shown in FIG. 2*a*, an extremely thin material is being taken up, in consequence of which the tensioning element 10*a* is drawn by the spring 11 into a relatively low position in FIG. 2*a*, this being connected with a close application of the three draw-off rollers. If, on the contrary, a tubular fabric 1 of considerable thickness is being draw-off, the axles of the draw-off rollers 3 and 4, owing to their movable mounting, are shifted into the position shown in FIG. 2*b*, the tightening element 10*b* being drawn upward against the action of the spring 11. In this way, the gaps between the draw-off rollers can be adapted to any desired thickness of material. Purely for illustrative purposes, the tightening band of FIG. 2*b* is shown as a chain, rather than a belt as in FIG. 2*a*.

The drive of the draw-off rollers can alternatively be effected by the draw-off roller 2, for example, being positively driven, while the draw-off rollers 3 and 4 are driven off the draw-off roller 2 by means of the tightening band 9*a* or 9*b*. In this case the driving wheel 14*a* or 14*b* is omitted. For improving the effect of the tightening band 9*a*, 9*b*, either the take-up roller 4 may be under the action of a further spring, which prestresses it in the direction of the draw-off roller 3, or at least one further tightening element may be provided for the tightening band 9*a*, 9*b*.

For improving the uniformity of drawing-off it is expedient to provide on both edges of the draw-off rollers a respective tightening device consisting of a tightening band 9*a*, 9*b*, a tightening roller 10*a*, 10*b*, and a driving roller 14*a*, 14*b*, The result obtained by the mechanism, using very simple means, is that the size of the roller gaps between the individual draw-off rollers is practically without effect on the drive of the draw-off rollers and therefore no longer represents a critical dimension.

The invention can be used in corresponding manner in draw-off devices having two or more than three draw-off rollers.

What we claim:

1. A fabric drawing-off mechanism for knitting machines comprising, a first and at least a second draw-off roller, said rollers having parallel axles, a driving means for positively rotating said first and said second draw-off rollers, at the same speed; bearing means for at least one of said draw-off rollers, said bearing means providing relative motion between said draw-off rollers in a direction perpendicular to the parallel axles of said rollers during rotation of said rollers, guiding elements fixed to said draw-off rollers, and tightening means for resiliently pressing together said draw-off rollers in said direction, said driving means and said tightening means including a common endless tension member which at least partially passes around said guiding elements, around at least said driving means and around at least one tensioning element so that said tension member will at least drive said second draw-off roller and press both draw-off rollers together so that the distance between said draw-off rollers is variable in dependence on fabrics of varying thicknesses.

2. A fabric drawing-off mechanism according to claim 1, wherein said driving element is said guiding means of said first draw-off roller.

3. A fabric drawing-off mechanism according to claim 1, wherein said tension member at least partially passes around a separate driving element so that said driving element drives said draw-off rollers via said tension member.

4. A fabric drawing-off mechanism according to claim 1, said tension member being a belt, each guiding element being a pulley, and said tensioning element comprising a pulley secured to a spring-loaded lever.

5. A fabric drawing-off mechanism according to claim 1, said tension member being a chain, each guiding element being a chain wheel, and said tensioning element comprising a chain wheel secured to a spring-loaded lever.

6. A fabric drawing-off mechanism according to claim 1, including more than one tensioning element for tightening the tension member.

7. A fabric drawing-off mechanism according to claim 1, including a tensioning device on each of the draw-off rollers.

8. A fabric drawing-off mechanism for knitting machines comprising, three draw-off rollers, each of said rollers having parallel axles, a driving means for positively rotating said draw-off rollers at the same speed, bearing means for at least two of said rollrs, said bearing means providing relative motion between said draw-off rollers in a direction vertical to the parallel axles of said rollers during rotation of said rollers, guiding elements fixed to said draw-off rollers, and tightening means for resiliently pressing together said draw-off rollers in said direction, said driving means and said tightening means including a common endless tension member which at least partially passes around said guiding elements, around said driving means and around at least one tensioning element so that said tension member will at least drive two of said draw-off rollers and press said draw-off rollers together so that the distance between said draw-off rollers is variable in dependence in fabrics of variable thicknesses.

9. A fabric drawing-off mechanism according to claim 8, wherein said driving element is said guiding means of the draw-off roller not driven by said tension member.

10. A fabric drawing-off mechanism according to claim 8, wherein said tension member at least partially passes around a separate driving element so said driving element drives said three draw-off rollers via said tension member.

* * * * *